US005921693A

United States Patent [19]

Martiniak

[11] Patent Number: 5,921,693

[45] Date of Patent: Jul. 13, 1999

[54] BINDING SYSTEM FOR LOOSE LEAF PAPERS

[76] Inventor: L. J. Chris Martiniak, 1514 Le Roy Ave., Berkeley, Calif. 94708

[21] Appl. No.: 08/831,219

[22] Filed: Apr. 2, 1997

Related U.S. Application Data

[60] Provisional application No. 60/014,691, Apr. 2, 1996.

[51] Int. Cl.[6] ..... B42F 13/04

[52] U.S. Cl. ..... 402/9; 402/10; 402/19; 402/69; 402/75; 281/40

[58] Field of Search ..... 402/9–11, 14–19, 402/21, 69, 75; 281/40

[56] References Cited

U.S. PATENT DOCUMENTS

| | | | |
|---|---|---|---|
| 194,230 | 8/1877 | England . | |
| 581,124 | 4/1897 | Leslie . | |
| 603,428 | 5/1898 | Leslie . | |
| 767,940 | 8/1904 | Grimme . | |
| 910,867 | 1/1909 | Schraeger . | |
| 1,128,441 | 2/1915 | Gilda . | |
| 1,322,344 | 11/1919 | Reschke . | |
| 1,507,045 | 9/1924 | Burroughs et al. . | |
| 1,547,302 | 7/1925 | Cottrell . | |
| 1,548,147 | 8/1925 | Leach . | |
| 1,700,196 | 1/1929 | Loss . | |
| 1,754,418 | 4/1930 | Loss . | |
| 1,772,567 | 8/1930 | Loss . | |
| 2,007,763 | 7/1935 | Klein . | |
| 2,072,494 | 3/1937 | Bowen . | |
| 2,372,717 | 4/1945 | Federn . | |
| 2,879,772 | 3/1959 | Murphy et al. . | |
| 3,507,601 | 4/1970 | Smith . | |
| 4,149,738 | 4/1979 | Illos et al. . | |
| 4,369,013 | 1/1983 | Abildgaard et al. | 412/38 |
| 4,595,309 | 6/1986 | Chinchar | 402/80 R |
| 4,772,149 | 9/1988 | Wright . | |
| 4,775,257 | 10/1988 | Rigg | 402/9 |
| 5,213,370 | 5/1993 | Hood | 281/36 |
| 5,242,236 | 9/1993 | Isac | 402/9 |
| 5,255,992 | 10/1993 | Nicklow . | |
| 5,259,683 | 11/1993 | Lubbe | 402/68 |

*Primary Examiner*—Frances Han
*Attorney, Agent, or Firm*—Jeffrey P. Aiello; Carol D. Titus; James J. Leary

[57] ABSTRACT

A binding system for loose-leaf sheets of paper that securely retains the paper and provides facile removal and addition of paper bound by the system is provided. The system provides a variable width binding, for addition and removal of papers, and a flexible spine. A plurality of resilient connecting members extend arcuately between first and second backing members, when the system is in an open position. The connecting members extend through openings in an adjustment assembly coupled to the second backing member. The adjustment assembly is provided for simultaneously increasing and decreasing the length of the connecting members, and for maintaining the connecting members at different desired lengths for binding paper with the system or removing paper from the system. Paper having a plurality of slots is positioned on a cover, with a connecting member extending through each slot. The adjustment assembly is actuated for either reducing the length of the connecting members, to draw the backing members together and bind the papers therebetween, or for increasing the length of the connecting members, for adding or removing papers bound by the binding system.

20 Claims, 5 Drawing Sheets

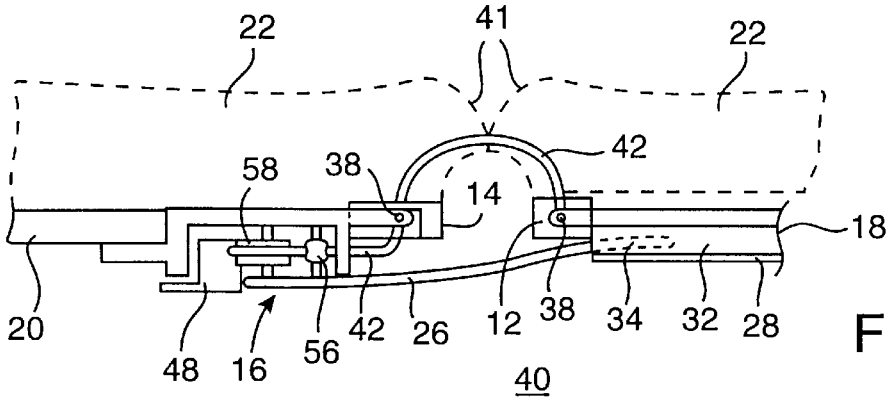
FIG. 4
FIG. 5
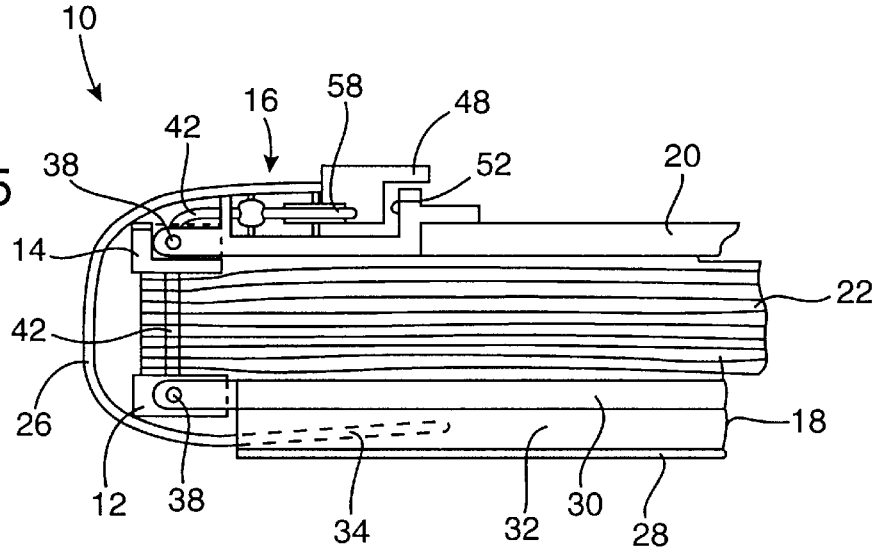
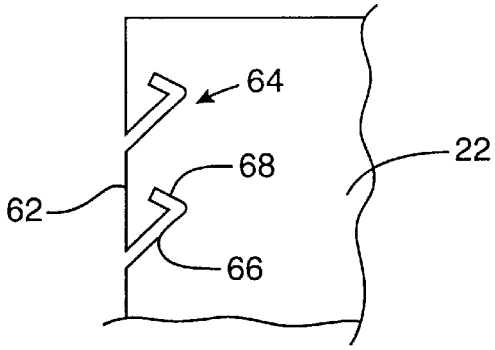
FIG. 6

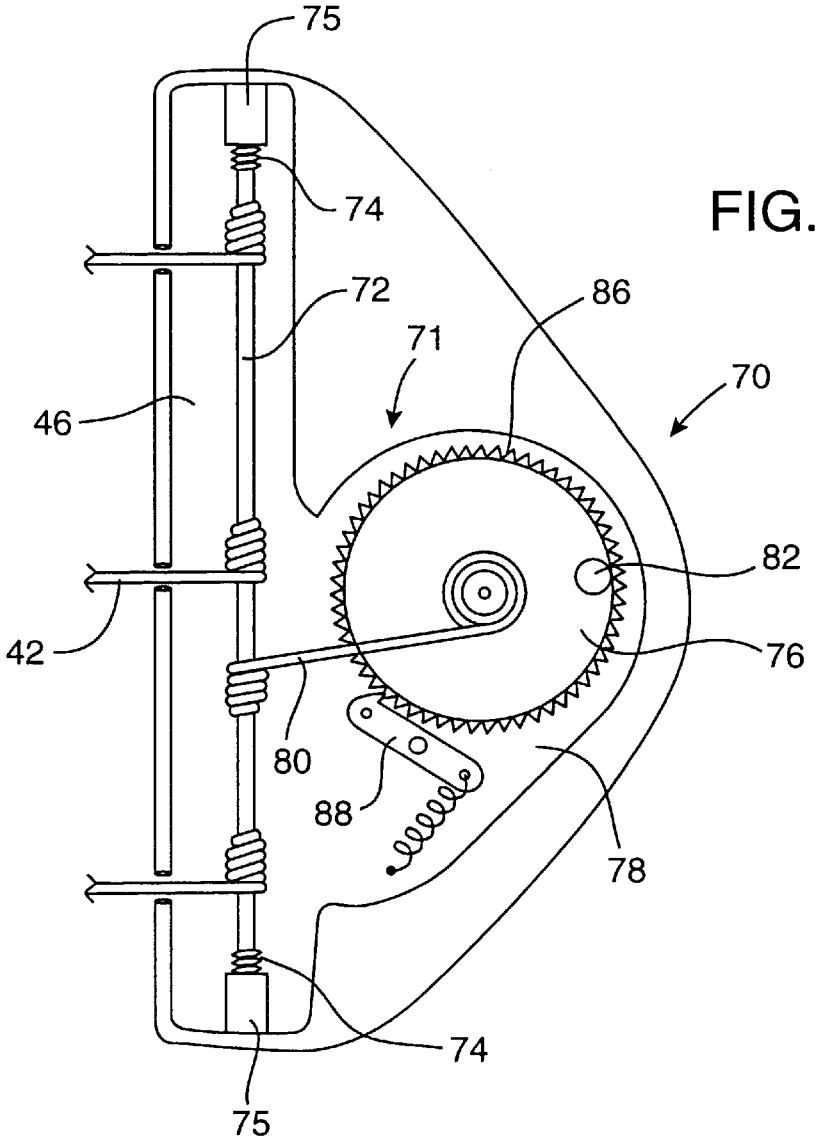
FIG. 8
FIG. 9
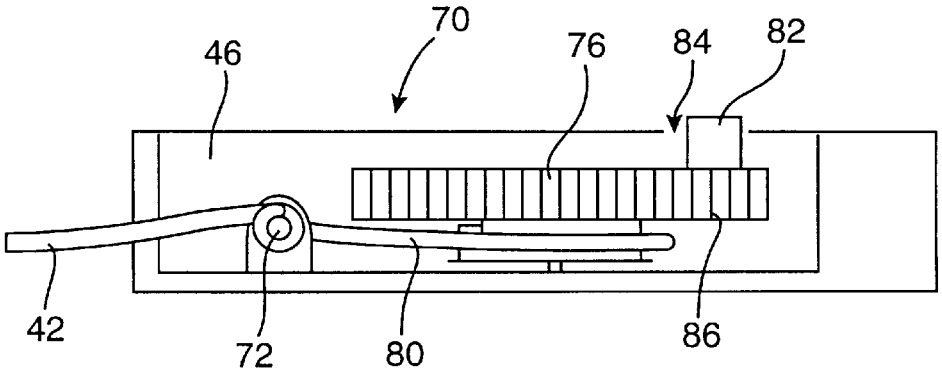

BINDING SYSTEM FOR LOOSE LEAF PAPERS

This application claims the benefit of U.S. Provisional application Ser. No. 60/014,691, filed Apr. 2, 1996.

BACKGROUND OF THE INVENTION

1. Field of the Invention

The present invention relates generally to loose-leaf binders that provide the releasable insertion of sheets of paper, and more particularly, to an improved and simplified binding system for loose-leaf sheets of paper that securely retains loose-leaf paper while enabling removal and addition of paper bound by the system.

2. Description of Related Art

Loose-leaf or ring binders for holding sheets of paper are well known in the art. These binders typically comprise front and back covers hingably connected to a spine. The spine usually comprises a metal or hard plastic and includes a plurality of spatially positioned two piece rigid rings for retaining the sheets of paper. The rings are opened and closed for adding and removing paper from the binder, and comprise known configurations such as annular or D-shaped, for example and rigid materials, such as steel or aluminum.

However, a disadvantage common to these binders, is that the rings have a fixed diameter, to accommodate a desired maximum amount of paper to be held by the binder. The spine is typically wider than the diameter of the rings, so that paper may be easily added or removed from the binder. Thus, the spine is substantially wider than the open end of the binder which gives the binder a triangular cross-sectional configuration, with the front and back covers extending obtusely toward each other from the wide spine. The triangular cross-sectional configuration makes it somewhat difficult to stack a number of these binders on top of each other, and additionally, it is difficult to place the binders adjacent to books on a bookshelf, due to the angularity of the binders. Further, since the rings are a fixed diameter and the spine is a fixed width, a substantial amount of space, such as shelf space on a bookcase, is wasted when the binder is not full of paper.

Devices in the prior art have attempted to overcome some of the disadvantages of ring binders. One such device is disclosed in U.S. Pat. No. 4,369,013, to Abildgaard et al., which teaches bookbinding strips. The disclosed strips are provided with plastic studs which fit through holes vicinal one margin of each sheet of paper. The studs may be integrally formed in one strip, or may be alternating in both strips. Holes are provided in one strip, or both strips, for receiving the studs. Excess stud lengths are sheared and headed to lock the strips and sheets of paper interposed between the strips in position. A disadvantage of the disclosed device, is that once the studs are sheared and headed, papers cannot be added or removed from the binding system, without destroying some component of the system necessitating the installation of new strips. Also, when many papers are bound by the disclosed device, the bound pages are substantially difficult to spread open and lie flat due to the stiff spine formed by the studs extending between the strips, making it difficult to read text adjacent to the spine of the device.

Another binding device is disclosed in U.S. Pat. No. 5,213,370, to Hood, which is directed to an expandable loose-leaf volume. The disclosed volume comprises an expandable spine that may be incorporated into a loose-leaf photograph album or binder. The spine has an expansion means which allows the user to increase or decrease the capacity of the spine to match the volume of the contents. A flexible material covers the spine to give it the appearance of a bound book. Between the expansion means and the flexible material is a resilient material that serves as a means to compensate for the change in width of the spine so that the flexible material remains smoothly fitted to the spine. In this way the spine maintains the appearance of a bound book at any state of expansion. An album incorporating the spine also includes a page retaining means which is attached to the spine and a front and back cover which are hinged to the spine.

U.S. Pat. No. 5,242,236, to Isac, is directed to a holder for holding a plurality of sheets formed with holes adjacent to one of their edges. The holder includes a backing member and a pair of slides. The slides are slidable along each end of a track that extends along the width of the upper end of the backing member. The holder includes cords that have mating connectors at one end to permit the plurality of sheets to be secured to a length-varying device. The length of the cords can be varied according to the number of sheets to be secured by the cords. The length-varying device comprises a long portion of VELCRO® retained in the track. Mating portions of VELCRO® are secured to the cords and detachably coupled to the track, for adjusting the length of the cords. A disadvantage of the disclosed holder, is that it is difficult to remove or add paper to the holder because the cords are flaccid. Further, the two piece cords must be separated or when adding or removing paper, similar to that of conventional ring binders.

U.S. Pat. No. 2,879,772, to Murphy et al., discloses a loose-leaf binder that includes a pair of retainer members, each comprising a length of flexible wire, such as piano wire. A disadvantage of the disclosed binder, is that the retainer members each comprise a closed loop, which extends substantially above the plane of the upper surface of the cover. Thus, the binders are not well suited for stacking on top of each other or for placing the binders adjacent to books on a bookshelf, a disadvantage similar to that of ring binders.

Additional loose-leaf binders are disclosed in U.S. Pat. No. 2,372,717, to Federn; U.S. Pat. No. 2,007,763, to Klein; U.S. Pat. No. 1,548,147, to Leach; and U.S. Pat. No. 4,775,257, to Rigg.

There, therefore exists a need for an improved and simplified binding system for loose-leaf sheets of paper that securely retains the paper and that provides facile removal and addition of papers bound by the system, and further enables front and back covers thereof to extend substantially parallel to each other regardless of the quantity of paper bound by the binding system.

OBJECTS OF THE INVENTION

It is therefore an object of the present invention to provide an improved and simplified binding system for loose-leaf sheets of paper;

It is another object of the present invention to provide a binding system for loose-leaf sheets of paper that securely retains the paper while providing facile removal and addition of paper bound by the system;

It is a further object of the present invention to provide a binding system for loose-leaf sheets of paper that enables front and back covers coupled thereto to extend substantially parallel to each other regardless of the quantity of papers retained by the binding system;

It is yet another object of the present invention to provide a binding system for loose-leaf sheets of paper that provides facile access to desired sheets of paper bound by the binding system;

It is a still further object of the present invention to provide a binding system for loose-leaf sheets of paper that provides a flexible spine for providing facile viewing of text or figures on paper bound by the system, and particularly text or figures in the margins of the paper adjacent the binding system;

It is another object of the present invention to provide a binding system for loose-leaf sheets of paper configured with a flexible spine that adjusts to the amount of paper bound by the system for eliminating space unnecessarily occupied by a conventional binding system, such as shelf space; and It is a further object of the present invention to provide a binding system for loose-leaf sheets of paper that includes adjustable connecting members for holding papers that provides facile addition or removal of papers bound by the system.

SUMMARY OF THE INVENTION

These and other objects and advantages of the present invention are achieved by providing an improved and simplified binding system for loose-leaf sheets of paper that securely retains the paper while providing facile removal and addition of papers bound by the system. Additionally, the invented binding system has a variable width flexible spine. The spine enables viewing of text adjacent thereto, while preventing a binder incorporating the invented system from occupying unnecessary space.

In the preferred embodiment, the invented binding system comprises first and second backing members hingably coupled to front and back covers for providing a complete loose-leaf binder. A flexible spine protector may be provided to inhibit inadvertent longitudinal movement between the backing members. The spine protector may be secured to one of the backing members and slidably retained in a pocket formed in an opposing cover.

A plurality of resilient connecting members are provided for flexibly coupling the backing members together. The connecting members extend somewhat arcuately between the backing members and comprise a substantially flexible material that is just sufficiently resilient to retain the arcuate shape of the connecting members when the binder is open. The arcuate shape of the connecting members allows easy attachment and removal of papers bound by the system. Suitable materials for the connecting members may include monofilament or nylon line, or suitable small diameter wire. Preferably, the connecting members are affixed to one of the backing members, such as the first backing member, and extend through openings in the remaining or second backing member and are coupled to an adjustment assembly.

The adjustment assembly is provided for increasing and decreasing the length of the connecting members simultaneously. The adjustment assembly is actuated for enabling the binding system to accommodate varying quantities of paper and for enabling viewing of text adjacent to the margins of paper bound by the system. The adjustment assembly includes a base having a channel. The connecting members extend into the channel and are attached to an adjustment means retained in the channel. The adjustment means is actuated for adjusting the length of the connecting members to increase or decrease the distance between the backing members for binding paper therebetween.

In a first preferred embodiment, the adjustment means includes a pulley affixed to the base of the adjustment assembly to aid with adjusting the length of the connecting members. Optionally, a spring may be provided between the pulley and a slide for providing tension on the connecting members, for binding paper between the covers. The spring permits the length of the connecting members to expand slightly under tension, when the bound paper is opened, allowing the connecting members to form an arc. The spring also permits spreading of the sheets of paper to view text or figures adjacent to the inner margins of paper bound by the invented binding system. The length of the connecting members is adjustable for enabling the binding system to bind different amounts of paper, so that the binder, and particularly the spine, does not waste space, such as shelf space, as is a common disadvantage of prior art ring binders, due to their triangular cross-sectional configuration caused by their rigid rings and spines.

The channel is provided with means for holding the slide at different desired longitudinal locations in the channel. The holding means may comprise ratchet teeth formed on a side of the channel, with a corresponding mechanism formed in the slide. Alternatively, the holding means may comprise a cam mechanism that frictionally engages the side of the channel for holding the slide at the different desired locations in the channel. Suitable means, such as a switch for example, are provided for disengaging the holding means for adjusting the slide along the channel.

In a second preferred embodiment, the adjustment means includes an elongated shaft rotatably retained in the channel, with each of the connecting members secured thereto. A crank is coupled to the shaft for rotating the shaft for adjusting the length of the connecting members. The crank preferably includes directional control means for controlling the rotation direction of the shaft, when rotating the shaft to either decrease or increase the length of the connecting members for binding or removing paper, between the backing members, thus maintaining a desired length of the connecting members.

Optionally, hinge means may be provided for coupling one of the backing members to a cover member and for coupling the remaining backing member to the adjustment assembly. The hinge means in combination with the flexible spine enable the covers to lay substantially flatly on a surface for viewing text or figures on paper bound by the present invention.

In use, paper is provided with a plurality of slots formed through the edge thereof. The edge of the paper is positioned on the connecting members, with a connecting member extending through each slot. The adjustment means is actuated for reducing or increasing the length of the connecting members. When the adjustment means is actuated for reducing the length of the connecting members, the backing members are drawn together until the paper is held tightly therebetween, thus binding the paper.

When it is desired to add or remove sheets of paper bound by the invented binding system, the adjustment means is actuated to increase the length of the connecting members to loosen paper bound by the system. Desired sheets of paper can then be easily added to, or removed, from the binding system, since the connecting members retain their arcuate shape and separating the connecting members is not required, as with prior art ring binders and the like. The length of the connecting members is reduced by again actuating the adjustment means to once more bind the paper.

The connecting members, in combination with the flexible spine and hinge means, provide a flexible coupling that enables the covers to lay substantially flatly on a surface, for viewing text or figures on the paper. Particularly, since each cover lays flat on a surface, such as a desk for example, text or figures in the margins are not obscured from view by the binding system, as is the case with the binding system disclosed in U.S. Pat. No. 4,369,013. Additionally, if a small portion of text is obscured from view by the present invention, the length of the connecting members may be increased, so that adjacent sheets of paper lie in a plane, for viewing the entire sheet of paper.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 4 is a fragmentary, end view showing of the present invention in an open position;

FIG. 5 is a fragmentary, end view showing the present invention in a closed position with loose-leaf paper bound thereby;

FIG. 6 is a fragmentary, top plan view showing a portion of a sheet of paper configured to be bound by the present invention;

FIG. 8 is a cross-sectional view of a second embodiment of the adjustment assembly of the present invention; and FIG. 9 is a plan view of the second embodiment of the adjustment assembly of the binding system of the present invention.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Figure 1:
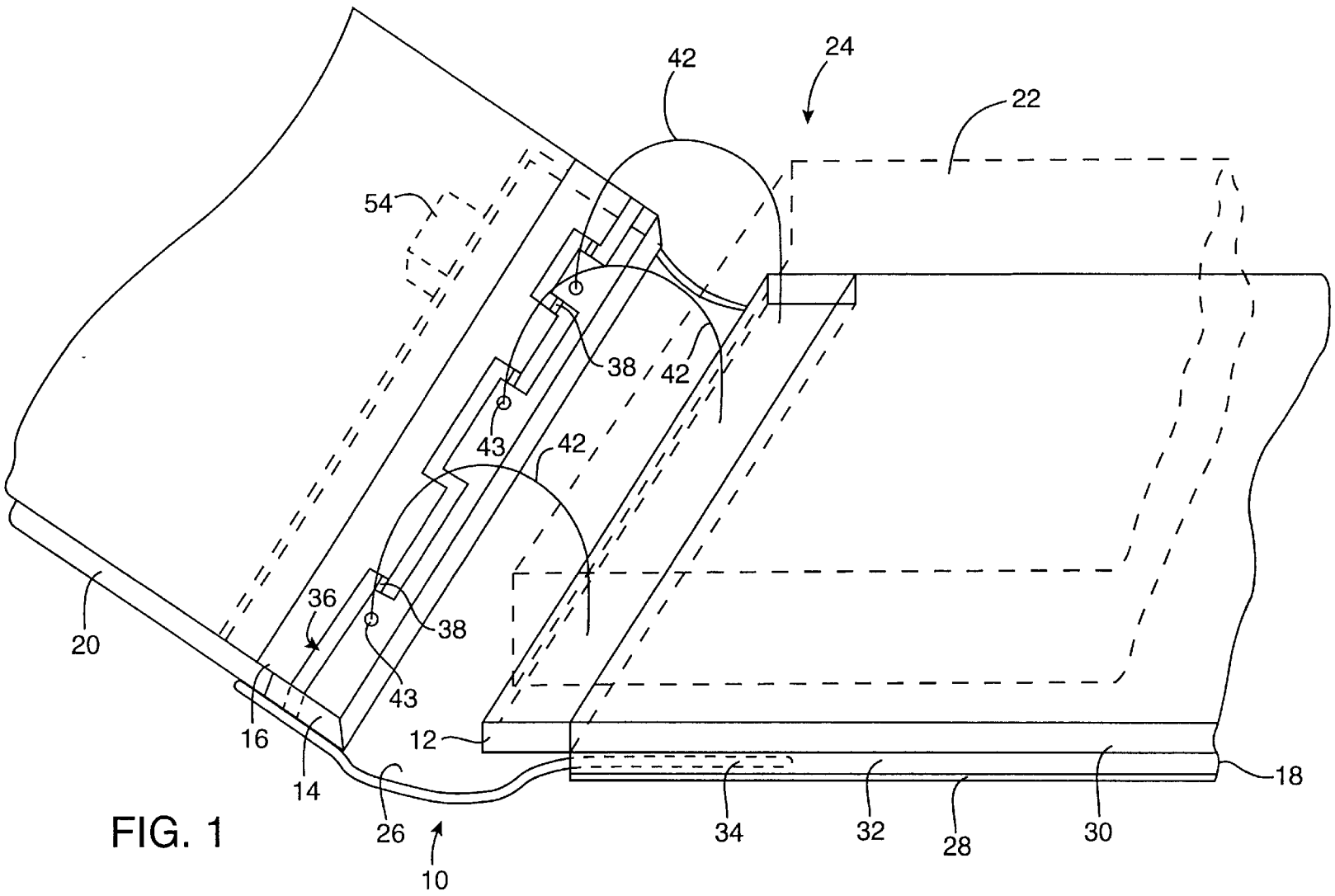
FIG. 1 is a front elevational, schematic view showing a preferred embodiment of a binding system for loose-leaf sheets of paper constructed according to the principles of the present invention.
Figure 2:
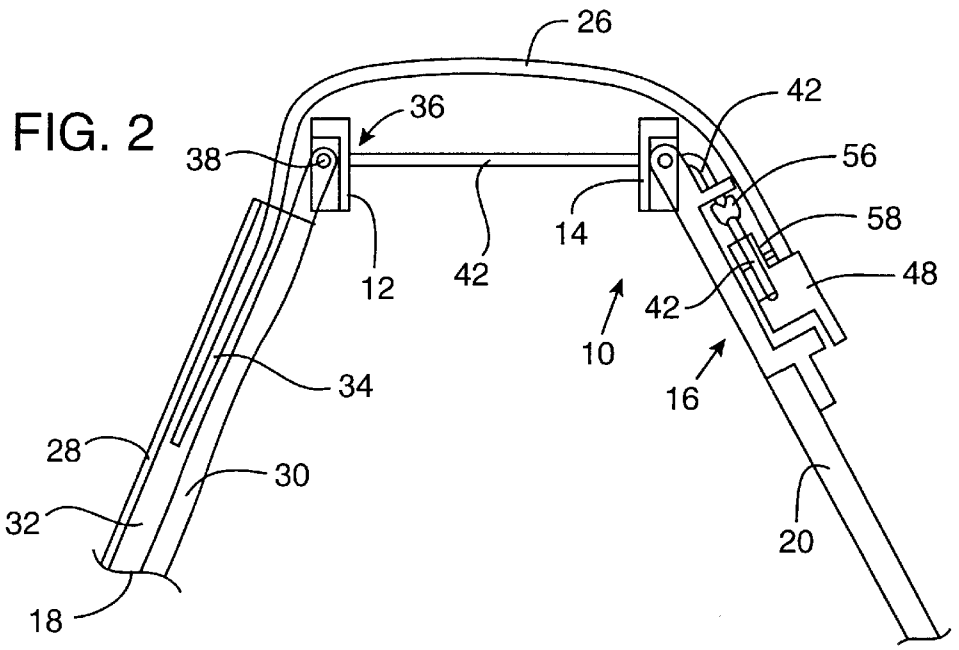
FIG. 2 is a top plan, schematic view, partially is cross-section showing the present invention.

Referring now to FIGS. 1, 2, and 5 of the drawings, there is shown, generally at 10, a preferred embodiment of a binding system constructed according to the principles of the present invention. The invented binding system 10 comprises a first elongated backing member 12 and a second elongated backing member 14 hingably coupled to a first embodiment of an adjustment assembly 16. The first backing member 12 is hingably connected to a first cover member 18, while the adjustment assembly 16 is affixed to a second cover member 20. The covers 18, 20 protect paper 22 bound by the invented system 10 for providing a complete loose-leaf binder, shown generally at 24. The covers 18, 20 may comprise known plastics or paperboard, such as cardboard, with a suitable covering, such as vinyl as is well known in the art.

Optionally, a substantially flexible spine protector 26 may be affixed to either the adjustment assembly 16, second backing member 14, or both, and coupled to one of the covers, such as the first cover 18. Preferably, the cover 18 is configured with an outer layer 28 and an inner layer 30 providing a pocket 32 therebetween. The spine protector 26 may comprise any suitable pliable polymeric material that is just sufficiently strong to inhibit inadvertent relative longitudinal movement between the backing members 12, 14. Preferably, the spine protector 26 is secured to the adjustment assembly 16 using known means and has an end region 34 movably retained in the pocket 32. The end region 34 is movable so that the protector 26 maintains its somewhat cylindrical shape regardless of the amount of paper 22 bound by the system 10, and so that there is not an excessive portion of the protector 26 extending between the two backing members 12, 14.

The backing members 12, 14 are substantially narrow and may be different desired lengths, such as 11 inches for example, depending upon the length of paper to be bound by the system 10. The backing members 12, 14 comprise a suitable substantially light, rigid material, such as known polymeric materials and appropriate metal alloys, and are fabricated using known methods such as injection molding, for example.

Referring now to FIGS. 1–5 and FIG. 7 of the drawings, hinge means 36 are provided for coupling the first backing member 12 to the first cover member 18 and for coupling the second backing member 14 to the adjustment assembly 16. The hinge means 36 may comprise any suitable means that enables the first cover 18 to pivot about the first backing member 12 and the adjustment assembly 16 to pivot on the second backing member 14. For example, the hinge means 36 may comprise a flexible portion of plastic that extends between the first cover 18 and first backing member 12 when the cover 18 and backing member 12 are integrally molded. The adjustment assembly 16 and second backing member 14 would be similarly fabricated and connected together.

Figure 3:
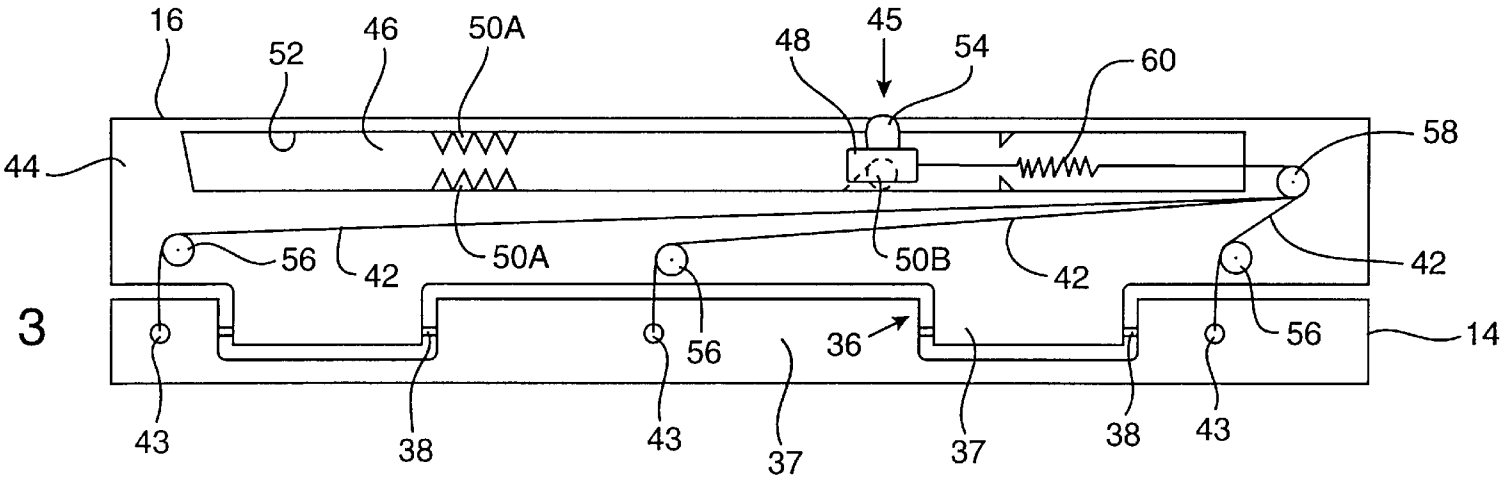
FIG. 3 is a bottom plan, schematic view showing a first embodiment of an adjustment assembly of the present invention.
Figure 7:
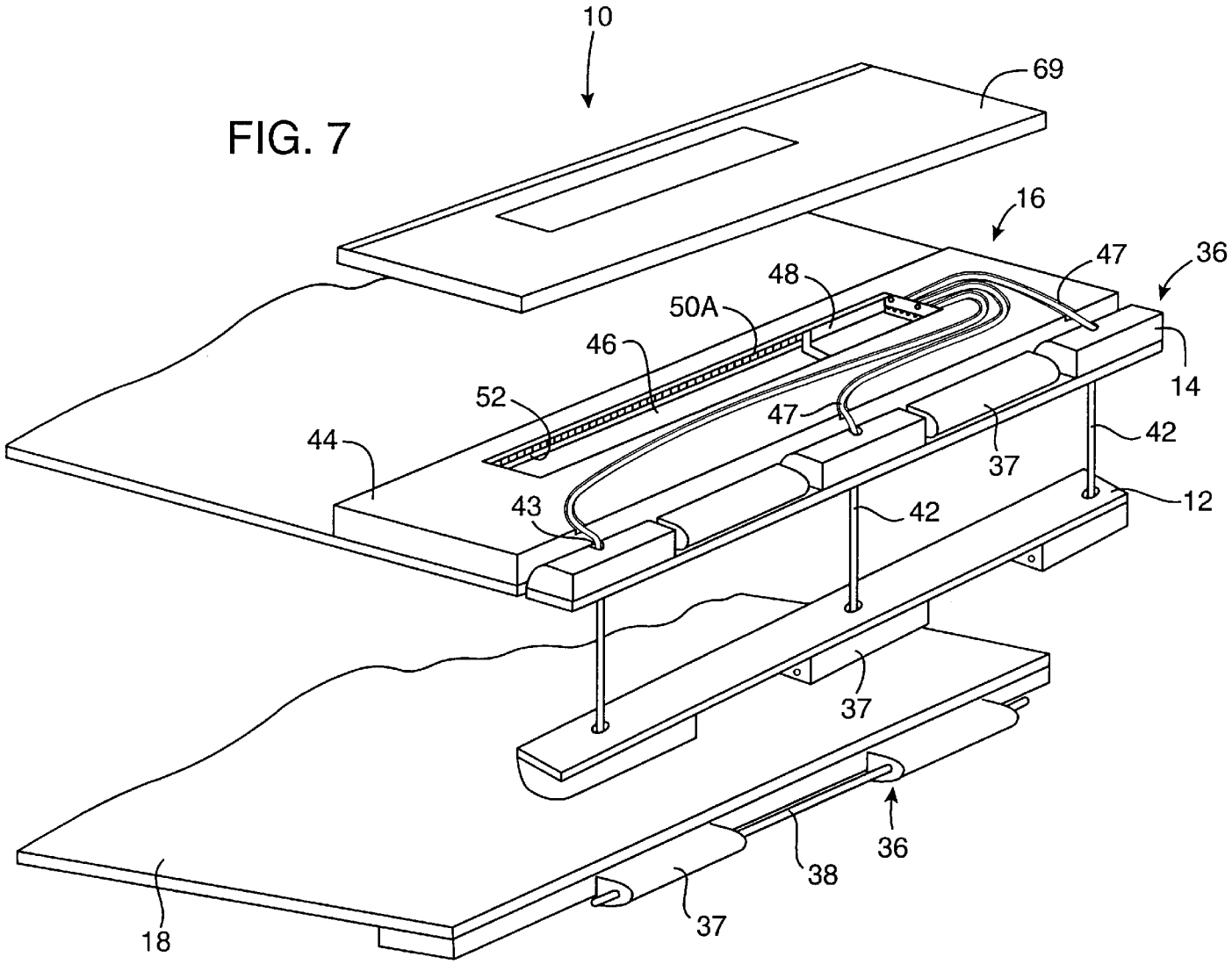
FIG. 7 is an exploded perspective view showing the present invention incorporating the first embodiment of the adjustment assembly.

As shown in the drawings, and particularly FIG. 1 and FIG. 3, the hinge means 36 preferably comprises a known butt-type hinge 36 comprising a plurality of interleaved sections 37 with a pivot pin 38 extending through the sections 37 for pivotally connecting the backing member 12 to the adjustment assembly 16. The first backing member 12 is similarly connected to the cover 18. The spine protector 26 and hinge means 36 enable the covers 18, 20 to lay substantially flatly on a surface 40 for viewing text or figures on the paper 22, and particularly text adjacent to inner margins 41 the paper 22 proximal to the system 10.

Referring still to FIGS. 1–5 and FIG. 7, in the open position a plurality of connecting members 42 preferably extend somewhat arcuately between the backing members 12, 14. The connecting members 42 preferably comprise a substantially flexible material that is just sufficiently resilient to retain the preferred arcuate shape of the members 42 when a binder 24 embodying the present invention 10 is open. The arcuate shape of the members 42 provides easy attachment, or removal, of papers 22 bound by the invented system 10. Suitable materials for the connecting members 42 include a heavy gauge monofilament line, nylon line, or suitable small diameter wire, for example. In the preferred embodiment, the connecting members 42 are affixed to the first backing member 12 and extend through openings 43 in the second backing member 14 and are coupled to the adjustment assembly 16. The binding system 10 of the present invention may be provided with a plurality of connecting members 42, ranging from 2 to 5, or more, depending upon the type and length of paper 22 bound by the system 10 and the characteristics of the selected material comprising the members 42, for example.

The adjustment assembly 16 is provided for increasing and decreasing the length of the connecting members 42 simultaneously and for maintaining the length of the connecting members 42 at different desired lengths for either binding paper 22 therebetween or for adding and removing paper 22. It will be readily apparent to those skilled in the art, that several different methods may be implemented for simultaneously adjusting and maintaining the length of each of the connecting members 42.

In a first embodiment, the adjustment assembly 16 has a base 44 configured with an elongated channel 46, that extends substantially the length of the base 44. Adjustment means, shown generally 45, are provided for adjusting the length of the connecting members 42. In the first embodiment 16, the adjustment means 45 includes a slide 48 that is movably retained in the channel 46. The channel 46 is provided with holding means for holding the slide 48 at different desired longitudinal locations therein for maintaining the connecting members 42 at different desired lengths.

The holding means may comprise ratchet teeth 50A formed on a side 52 of the channel 46. In the first embodiment, the slide 48 is configured with suitable means for disengaging the slide 48 from the holding means, such as a push-button switch 54 for example. The slide 48 is provided with a corresponding known mechanism for engaging and disengaging the slide 48 from the teeth 50A. The switch 54 may be depressed by a user, for releasing the slide 48 from the teeth 50A, then released so that the slide 48 engages the teeth 50A.

Alternative holding means may comprise a cam mechanism 50B (shown in phantom) coupled to the slide 48, for frictionally engaging the side 52 of the channel 46, when the channel 46 is not provided with teeth 50A. The switch 54, as previously discussed, is actuated to release the cam mechanism 50B from the side 52 of the channel 46, for moving the slide 48 along the channel 46. Other appropriate holding means which enable the slide 48 to be slid along the channel 46, while holding the slide 48 at the different desired locations in the channel 46 for maintaining the connecting members 42 at different desired lengths, are anticipated by the scope of the invented binding system 10.

The connecting members 42 extend through the openings 43 in the second backing member 14 and through curvilinear grooves 47 in the base 44, and are coupled to the slide 48. If it is desired to gain a mechanical advantage for increasing the binding force that the backing members 12, 14 exert on the paper 22, the members 42 can be coupled to the slide 48 with pulleys 56, 58. When the first embodiment of the adjustment assembly 16 is configured with pulleys, each connecting member 42 is first routed around a first pulley 56 located adjacent to the hinge means 36, then routed around a main pulley 58 secured to the base 44 adjacent to the channel 46.

Additionally, a spring 60 may be provided between the main pulley 58 and slide 48, for coupling the connecting members 42 to the slide 48. The spring 60 provides tension on the connecting members 42 for causing the backing members 12, 14 to bind the paper 22 therebetween. The spring 60 permits the length of the connecting members 42 to expand slightly under tension, when the bound paper 22 is opened, allowing the connecting members 42 to form an arc, as shown in FIG. 1 and FIG. 4. The spring 60 also permits spreading of the sheets of paper 22 to view text or figures in the inner margin 41 adjacent an edge 62 of the paper 22. A cover plate 69 may be secured to the base 44 to prevent the connecting members 42 from inadvertently dislodging from the grooves 47 and for enhancing the aesthetics of the adjustment assembly 16. The cover plate 69 is secured to the base 44 using known means that preferably enable the cover 69 to detachably couple to the base 44.

Referring now to FIG. 8 and FIG. 9 of the drawings, a second embodiment 70 of the adjustment assembly is shown. The second embodiment 70 includes alternative adjustment means, shown generally at 71, that preferably provide a mechanical advantage when decreasing and increasing the length of the connecting members 42. In the second embodiment 70, the adjustment means 71 includes an elongated shaft 72 rotatably retained in the channel 46. Each of the connecting members 42 are secured to the shaft 72 for adjusting their length. The shaft 72 has helically threaded ends 74 retained in complementary threaded housings 75 for causing the shaft 72 to longitudinally traverse in the channel 46, while rotating for threading the connecting members 42 along its length.

A preferably disk shaped crank 76 is secured in an annular cavity 78 communicating with the channel 46. An actuation cable 80 is secured to the crank 76 and coupled to the shaft 72, enabling rotation of the shaft 72 with the crank 76. The crank 76 has a handle 82 affixed thereto for rotating the crank 76 to simultaneously adjust the length of the connecting members 42. The handle 82 projects slightly above the cover 20 through an aperture 84 formed therein for enabling actuation of the crank 76. The crank 76 preferably includes directional control means for controlling the rotation direction of the shaft 72, when rotating the shaft 72 to either decrease or increase the length of the connecting members 42 for binding or removing paper 22, between the backing members 12, 14, thus maintaining a desired length of the connecting members 42. The directional control means preferably includes a ratchet and pawl mechanism, wherein a plurality of teeth 86 extending about the periphery of the crank 76 are engaged by a spring-loaded pawl 88. The pawl 88 engages the teeth 86 to prevent undesired rotation of the crank 76, for maintaining the desired length of the connecting members 42.

Referring now to the drawing Figures, in use, each sheet of paper 22 is provided with a plurality of slots 64 formed through the edge 62 of the paper 22. The slots 64 may comprise any appropriate configuration that enables easy removal and attachment of the paper 22 to the connecting members 42, while preventing the paper 22 from inadvertently detaching from the connecting members 42 or moving freely about thereon. Preferably, the slots 64 are L-shaped with a first channel 66 that extends obtusely inwardly from the edge 62 and a second channel 68 that extends back toward the edge 62 of the paper 22. The sheets of paper 22 are positioned on the first cover 18, with the first channel 66 of each of the slots 64 aligned with a connecting member 42. The paper 22 is then adjusted on the connecting members 42, until a connecting member 42 extends through the second channel 68 of each slot 64.

When binding paper 22 with the invented system 10, depending upon the selected embodiment of the adjustment assembly 16, 70, the adjustment means 45, 71 are actuated for reducing the length of each of the connecting members 42 simultaneously. As the length of the members 42 is reduced, the first backing member 12 and cover 18, are drawn towards the second backing member 14 and cover 20. The length of the connecting members 42 is reduced until the sheets of paper 22 are bound between the backing members 12, 14 with a desired force, thus binding the paper 22.

The connecting members 42, in combination with the flexible spine protector 26 and hinge means 36, provide a flexible coupling that enables the covers 18, 20 to lay substantially flatly on the surface 40, for viewing text or figures on the paper 22, and particularly text adjacent to the inner margins 41 of the paper 22, and for facile access to desired sheets of paper 22 bound by the system 10 without interference by the system 10. Particularly, since each cover 18, 20 lays flat on the surface 40, text or figures adjacent to the edge 62 of the paper 22 are not obscured from view by the binding system 10, as is often the case with books or conventional binders. Additionally, if a small portion of text is obscured from view by the present invention 10, the length of the connecting members 42 may be increased, so that adjacent sheets of paper 22 lie in a plane, shown in FIG. 4, for viewing the entire sheet of paper 22.

Further, since the length of the connecting members 42 is reduced for binding the paper 22, the front and back covers 18, 20 extend parallel to the paper 22, regardless of the quantity of paper 22, and extend substantially parallel to each other. Thus, the present invention 10 provides a loose-leaf binder 24 that may be placed adjacent books, for example, and enables several binders 24 embodying the invented system 10 to be securely placed on top of each other. Since the covers 18, 20 abut the paper 22 when the binder 24 is closed, space occupied by binders 24 embodying the invented binding system 10 is not wasted.

If it is desired to add or remove paper 22 from the binding system 10, the adjustment means 45, 71 is actuated, such as by sliding the slide 48 in the first embodiment 16 to increase the length of the connecting members 42, or by actuating the crank 76 to rotate the shaft 72 for increasing the length of the connecting members 42. As the length of the connecting members 42 increases, the force that the backing members 42 exert on the paper 22 is released, so that the paper 22 is only held in place by the connecting members 42 and the configuration of the slots 64 in the paper 22. Desired sheets of paper 22 can then be added or removed from the system 10, using the previously discussed methods. The slide 48 is then adjusted away from the main pulley 58, to again bind the paper 22 together.

Thus, there has been described an improved and simplified binding system for loose-leaf sheets of paper that securely retains the paper while providing facile removal and addition of paper bound thereby. The connecting members of the present invention are sufficiently resilient for retaining their arcuate shape for adding and removing papers bound by the invented binding system. The flexible connecting members, in combination with the flexible spine protector and hinge means, provide a flexible coupling that enables the covers to lay substantially flatly on a surface, for facile access to desired sheets of paper bound by the system without inadvertent longitudinal movement between the backing members. Further, since the length of the connecting members is reduced for binding the paper, the front and back covers extend parallel to the paper, regardless of the quantity of paper, and extend substantially parallel to each other. Thus, the present invention provides a loose-leaf binder that does not waste space, such as shelf space on a bookcase.

Those skilled in the art will appreciate that various adaptations and modifications of the just-described preferred embodiments can be configured without departing from the scope and spirit of the invention. Therefore, it is to be understood that the invention may be practiced other than as specifically described herein.

What is claimed is:

1. A binding system for loose-leaf sheets of paper comprising:

a pair of backing members;

a plurality of resilient connecting members extending between the backing members and maintaining the backing members in a generally parallel relationship; and adjustment means for increasing and decreasing the length of the connecting members for enabling the binding system to bind paper, the adjustment means decreasing a length of the connecting members between the backing members for binding paper therebetween and increasing the length of the connecting members between the backing members for removing paper bound by the system, the adjustment means including actuation means for increasing the length of each of the connecting members simultaneously and for decreasing the length of each of the connecting members simultaneously.

2. The binding system of claim 1 wherein the connecting members are configured to engage paper bound by the system and to provide facile removal and addition of papers bound by the system.

3. The binding system of claim 1 wherein the connecting members comprise a resilient material predisposed to assume a substantially arcuate shape when flexed, such that the connecting members extend substantially arcuately between the backing members when the length of the connecting members is increased for removing paper bound by the system and for adding paper to the system.

4. The binding system of claim 1 wherein each of the backing members is coupled to a cover member for protecting paper bound by the system, a coupling provided between each backing member and the associated cover member for movably coupling the backing member to the cover member for enabling the backing members to pivot relative to the cover members for enabling the covers to lay flatly on a surface supporting the system to provide viewing of text on paper bound by the system proximal thereto.

5. A binding system for loose-leaf sheets of paper comprising:

a pair of backing members;

a plurality of resilient connecting members extending between the backing members and maintaining the backing members in a generally parallel relationship; and adjustment means for increasing and decreasing the length of the connecting members for enabling the binding system to bind paper, the adjustment means decreasing a length of the connecting members between the backing members for binding paper therebetween and increasing the length of the connecting members between the backing members for removing paper bound by the system, the connecting members comprising a resilient material predisposed to assume a substantially arcuate shape when flexed, such that the connecting members extend substantially arcuately between the backing members when the length of the connecting members is increased for removing paper bound by the system and for adding paper to the system.

6. The binding system of claim 5 wherein the adjustment means increase and decrease the length of the connecting members for enabling the binding system to accommodate varying quantities of paper.

7. The binding system of claim 5 wherein each of the backing members is coupled to a cover member for protecting paper bound by the system, a coupling provided between each backing member and the associated cover member for movably coupling the backing member to the cover member for enabling the backing members to pivot relative to the cover members for enabling the covers to lay flatly on a surface supporting the system to provide viewing of text on paper bound by the system proximal thereto.

8. A binding system for loose-leaf sheets of paper comprising:

a pair of backing members;

a plurality of resilient connecting members extending between the backing members and maintaining the backing members in a generally parallel relationship; and adjustment means for increasing and decreasing the length of the connecting members for enabling the binding system to bind paper, the adjustment means decreasing a length of the connecting members between the backing members for binding paper therebetween and increasing the length of the connecting members between the backing members for removing paper bound by the system, each of the backing members being coupled to a cover member for protecting paper bound by the system, a coupling provided between each backing member and the associated cover member for movably coupling the backing member to the cover member for enabling the backing members to pivot relative to the cover members for enabling the covers to lay flatly on a surface supporting the system to provide viewing of text on paper bound by the system proximal thereto.

9. The binding system of claim 8 wherein the adjustment means increase and decrease the length of the connecting members for enabling the binding system to accommodate varying quantities of paper.

10. A binding system for loose-leaf sheets of paper comprising:

a pair of backing members, each backing member pivotably coupled to a cover to protect paper bound by the system;

a plurality of elongated resilient connecting members maintaining the backing members in a generally parallel relationship, each of the connecting members having an end secured to one of the backing members and having a second end, the connecting members disposed to assume a substantially arcuate shape when flexed for causing the connecting member to extend arcuately between the backing members when the system is open to provide facile removal and addition of papers bound by the system and to enable viewing of text on paper bound by the system proximal thereto; and adjustment means for increasing and decreasing the length of each of the connecting members simultaneously for opening and closing the system, the adjustment means including actuation means coupled to the second end of each of the connecting members for adjusting the length of each of the connecting members simultaneously, wherein the actuation means is adjusted in a first direction to increase the length of the connecting members between the backing members for opening the system, the length of the connecting members continuously increasable from a position wherein the connecting members are just sufficiently long to bind paper between the backing members to a position wherein the connecting member form a desired arc between the backing members, and the actuation means adjusted in a second direction to decrease the length of the connecting members to draw the backing members toward each other to bind desired qualities of paper therebetween.

11. The binding system of claim 10 further comprising a flexible spine protector secured to one of the covers and slidably retained in an opening in the remaining cover, the spine protector inhibiting inadvertent longitudinal movement between the backing members when the system is open for adding and removing paper and when closing the system.

12. The binding system of claim 10 wherein the connecting members comprise a flexible material that is configured to have a substantially arcuate inclination, the resilient material selected from the group consisting of heavy gauge monofilament line, nylon line, and small diameter metallic wire, each connecting member comprising a single portion of line having an end affixed to one of the backing members and the second end thereof coupled to the adjustment means, the arcuate shape of the connecting members providing facile attachment and removal of papers bound by the system.

13. The binding system of claim 10 used in combination with at least one sheet of paper, and wherein each sheet of paper is provided with a plurality of slots formed through one of the side edges thereof, one slot provided for each connecting member, the slots configured to coact with the connecting member to provide easy removal and attachment of paper to the system, while preventing the paper from inadvertently detaching from the connecting member and moving freely about thereon.

14. The binding system of claim 13 wherein the slots are substantially L-shaped with a first channel extending obtusely inwardly from the edge and a second channel communicating with the first channel and extending back toward the edge of the paper.

15. The binding system of claim 10 wherein the adjustment means includes a base having a channel with the actuation means retained therein, the actuation means coupled to the second end of each of the connecting members for adjusting the length of each of the connecting members simultaneously.

16. The binding system of claim 15 wherein the actuation means comprises a slide mechanism movably retained in the channel, the slide having the second end of each of the connecting members coupled thereto, the slide adjusted along the channel for increasing and decreasing the length of the connecting members, the slide including means for engaging the channel to prevent inadvertent movement thereof in the channel to maintain the connecting members at different desired lengths.

17. The binding system of claim 16 wherein the adjustment means -further includes mechanical advantage means for increasing the force that the backing members exert on paper therebetween to bind the paper, the mechanical advantage means comprising a pulley affixed to the base to aid with adjusting the length of the connecting members, and a spring interposed between the pulley and the slide for providing tension on the connecting members, the spring allowing the length of the connecting members to expand slightly under tension, when the system is opened for viewing text on paper adjacent to inner margins of paper bound by the binding system.

18. The binding system of claim 15 wherein the adjustment means further comprises:

an elongated shaft rotatably retained in the channel, with each of the connecting members secured thereto, a crank member disposed in a cavity communicating with the channel, the crank coupled to the shaft for rotating the shaft for adjusting the length of the connecting members, the crank in combination with the shaft providing a mechanical advantage for increasing the force that the backing members exert on paper bound thereby, the crank including directional control means for preventing the crank from inadvertently rotating the shaft for maintaining the connecting members at different desired lengths.

19. The binding system of claim 18 wherein the shaft has helically threaded ends retained in complementary threaded housings formed at ends of the channel, the threaded ends causing the shaft to longitudinally traverse in the channel, while rotating for threading the connecting members along its length, the directional control means comprising a ratchet and pawl mechanism, including a plurality of teeth extending about the periphery of the crank and a spring-loaded pawl for engaging the teeth to prevent undesired rotation of the crank for maintaining the connecting members at different desired lengths between the backing members.

20. The binding system of claim 10 wherein hinge means are provided for coupling the backing members to the covers, the hinge means comprising a butt-type hinge comprising a plurality of interleaved sections with a pivot pin extending through the sections for pivotally connecting the backing members to the covers, the hinge means allowing the covers to lay substantially flatly on a surface supporting the system for enabling paper bound by the system to lay flatly on the covers exposing substantially an entire sheet of paper to enable viewing of text on the paper adjacent to inner margins thereof and proximal to the system.

* * * * *